US005347961A

United States Patent [19]

Buehrle, II et al.

[11] Patent Number: 5,347,961

[45] Date of Patent: Sep. 20, 1994

[54] ENGINE VALVE ACTUATING DEVICE

[76] Inventors: Harry W. Buehrle, II, 14 Alegria, Irvine, Calif. 92720; Lance E. Nist, 2824 S. Willis T., Santa Ana, Calif. 92705; Raymond C. Clark, 5861 Woodboro, Huntington Beach, Calif. 92649

[21] Appl. No.: 141,647

[22] Filed: Oct. 27, 1993

[51] Int. Cl.[5] ..... F01L 9/04

[52] U.S. Cl. ..... 123/90.11; 123/188.14; 123/184.53

[58] Field of Search ..... 123/90.11, 188.14, 52 M, 123/52 MB, 52 MC

[56] References Cited

U.S. PATENT DOCUMENTS

| | | | |
|---|---|---|---|
| 4,544,986 | 10/1985 | Büchl | 123/90.11 |
| 4,614,170 | 9/1986 | Pischinger et al. | 123/90.11 |
| 4,760,821 | 8/1988 | Aupor et al. | 123/188.14 |
| 4,779,585 | 10/1988 | Lequesne | 123/90.11 |
| 4,878,464 | 11/1989 | Richeson, Jr. et al. | 123/90.11 |
| 4,883,025 | 11/1989 | Richeson, Jr. | 123/90.11 |
| 5,058,857 | 10/1991 | Hudson | 251/30.05 |
| 5,197,428 | 3/1993 | Hornby | 123/296 |
| 5,203,830 | 4/1993 | Faletti et al. | 123/90.11 |
| 5,222,714 | 6/1993 | Morinigo et al. | 123/90.11 |

*Primary Examiner*—E. Rollins Cross
*Assistant Examiner*—Weilun Lo
*Attorney, Agent, or Firm*—Gordon K. Anderson

[57] ABSTRACT

An internal combustion engine valve actuating device located directly above each cylinder which has a co-axial venturi shaped duct (20) that is removably attached with threaded capscrews (24) and sealed with an o-ring (28). The interior of the duct contains a number of inwardly facing vanes (30) that hold an electromechanical valve actuator (48) complete with an engine intake valve (50). When a pulsed electrical signal is received by the actuator, opposed electromagnetic fields are developed reciprocating the valve. A fuel injection system introduces combustible fuel into the duct at the trailing edge of the vanes. The valve actuating device may also be applied to the exhaust system, less the fuel injection, and the valve actuator may be cooled by interconnecting cavities (60) within the vanes using engine coolant or oil.

18 Claims, 3 Drawing Sheets

ENGINE VALVE ACTUATING DEVICE

TECHNICAL FIELD

The present invention relates to valve actuating apparatus for engines in general. More specifically, to ducting fluid flow parallel to electromechanical actuators containing engine valves and introducing fuel into the engine cylinder through the duct.

BACKGROUND ART

Previously, many types of actuators have been used in endeavoring to provide an effective means for producing valve movement to introduce or eliminate gases from the cylinders of internal combustion engines. Valving arrangements of prior art universally convey gases to or from the valve by a chamber or duct approaching the valve at substantially right angles. It has been required in the past to duct the gases from the sides of the head of the engine and to leave the top surface of the head free for the location of the valve gear, such as cams, rocker arms, valve springs, hydraulic lifters, stem guides, and in some cases, push rods. The use of electrical actuation omits the need for these mechanisms and, therefore allows the installation arrangements to be parallel such that the gases approach the valve seat axially.

Even though prior art has utilized electromechanical actuators for alternately cycling engine valves from the open to the closed position using electromagnetic energy, no ducting has been specifically developed to employ this art in an efficient and expedient manner.

A search of the prior art did not disclose any patents that read directly on the claims of the instant invention, however the following U.S. patents are considered related:

| U.S. Pat. No. | Inventor | Issue Date |
|---|---|---|
| 4,544,986 | Büchl | Oct. 1, 1985 |
| 4,614,170 | Pischinger et al | Sep. 30, 1986 |
| 4,779,585 | Lequesne | Oct. 25, 1988 |
| 5,058,857 | Hudson | Oct. 22, 1991 |
| 5,197,428 | Hornby | Mar. 30, 1993 |
| 5,222,714 | Morinigo et al | Jun. 29, 1993 |

U.S. Pat. No. 4,544,986 issued to Büchl teaches a method and apparatus known as an electrical cam using low currents of opposite polarity electrical energy through two electromagnets.

Pischinger et al in U.S. Pat. No. 4,614,170 disclose a valve regulating apparatus wherein the pulse characteristics are close or equal to the natural frequency of a spring/mass valve system such that the valve is caused to oscillate to an amplitude reaching operational capabilities.

The U.S. Pat. No. 4,779,582 of Lequesne is for a valve member latched into open or closed positions by permanent magnet poles against the force of compressed springs.

Hudson, in U.S. Pat. No. 5,058,857, teaches a hydraulically actuated valve controlled by a electromagnet solenoid.

U.S. Pat. No. 5,197,428 of Hornby presents an electromagnetic fuel injector enclosing an intake valve stem. The injector has a non-magnetic body surrounded by a solenoid coil with an annular valve operated by the solenoid. The device has a central hole through which the valve stem passes.

The electromechanical valve actuator best suited to be used as an element in the instant invention is taught in U.S. Pat. No. 5,222,714 of Morinigo et al which has an upper and lower electromagnetic element with a core between. A valve stem is disposed within a central chamber and a spring biases the elements such that when an electrical current is passed through the elements, the valve opens and closes when the current is interrupted.

It may be seen that the prior art found by the search did not disclose any specific structure to apply an actuator to an engine valve in a removable manner or alignment of the valve stem parallel with intake or exhaust throats or other novel functional characteristics which are presently taught in the instant invention.

DISCLOSURE OF THE INVENTION

In the context of this invention, an electromechanical actuator is understood to mean a device which moves a valve to the open and closed position by utilizing electromagnetic or other external forces. Intake and exhaust valves for reciprocating internal combustion engines are normally actuated by synchronized cams, rocker arms, hydraulic lifters stem guides and, in some cases, push rods. The mechanical drive arrangements of prior art limit the flow path to flow at near right angles to the valve stem. Thus, in a valve in head engine the intake and exhaust necessarily are routed to the sides of the head, with the valve stem being oriented almost vertically. This arrangement forces the gas to take a substantially ninety degree turn as it approaches and flows through the valve seat. It also must flow around the valve stem and its guide to reach the opposite side of the valve seat. This results in increased pressure drop, and a loss of gas inertia. This causes an increase in emissions and reduction in the volumetric efficiency of the engine. The result is a reduction in the potential horsepower, and an increase in fuel consumption. Similarly, in the case of a prior art exhaust valve, the exiting gases must take a substantial turn to exit from the side of the block. In doing so, it must flow around the valve stem. This arrangement creates a nonuniform flow pattern, with one side of the valve flowing more freely than the other. With the instant invention, the gas exits straight out and flows from all edges of the valve equally. It is, therefore, a primary object of the invention to utilize an electromechanical actuator that is located in a duct that is co-axial to the valve stem. The gas flow, in the form of air and fuel or exhaust, approaches the valve normal to the valve seat and is not forced to turn and change directions in order to enter or exit the valve opening. In this manner, free and uniform flow is promoted on the full periphery of the valve and engine volumetric efficiency is substantially improved.

The invention includes an electromechanical actuator that is mounted on vanes as a streamlined body, central to a tubular flow passage. The intake air and fuel then pass in a near straight line from the ambient environment to the valve seat. In this manner, gas inertia is maintained, and all sides of the valve receive flow equally and pressure loss is minimized, therefore allowing the valve head to be smaller in diameter. This reduces the moving mass and, therefore permits reduction in the power and size of the electromechanical actuator.

An important object of the invention is that the duct and valve assembly is removable from the exterior of the engine in one piece, thereby not requiring disassembly of the engine to repair or replace the valve.

Prior art demonstrates valve opening by moving inward into the combustion chamber. This invention also includes valves that open away from the combustion chamber. The outwardly opening actuator/valve system improves the ease of removal and installation of the actuator/valve system. A secondary advantage is the elimination of a resilient seal and potential failure or leakage therebetween.

This object overshadows prior art where the duct that conveys the gases to the valve is part of the cylinder head of the engine and is usually connected to a group of valves through a manifold arrangement. The removal of the entire head is required in many instances for overhaul and component replacement which becomes costly and labor intensive. Removing a single valve without effecting the balance of the engine is a great advantage, particularly on multi-cylinder engines, such as used in motor vehicles.

Another object of the invention is directed to the construction of the duct that holds the actuator and valve. The duct is terminated by a bell mouth that reduces inlet pressure losses and may include a reflective baffle to acoustically terminate the inlet end while improving volumetric efficiency. The duct cross sectional area in the vicinity of the actuator is contracted to form a venturi. The local low pressure that is subsequently created is used to assist in the flow of gaseous fuel in the same method used in carburetion as a vacuum is created in this area and may be part of a self aspirating carburetor system. In simpler engines, such as motorcycles, outboards, racing engines, etc., this is a significant improvement and a cost reduction may be realized.

Still another object of the invention is the straight duct path which is suited to acoustical tuning of duct length to coincide with running frequency pulsation of the engine providing increased volumetric efficiency. In application the duct is tuned by changing the length to resonate at the pulsation frequency of the engine. The length of the duct is, therefore adjustable or of a specific length for each engine if operated at a governed speed. Further, it may be dynamically extended or shortened through the action of a linear actuator.

Yet another object of the invention is the ability of the device to feed fuel into the venturi throat through the vanes that are primarily used for actuator support. The fuel is fed from the downstream, or trailing edges of the vanes, and is then dispersed and mixed in the induction air. The device, therefore functions as a carburetor. The fuel valve opening time is controlled by an engine computer to serve as the throttling function. If the valve is opened a short time, throttling occurs and the engine runs slowly. If the fuel valve is opened longer, the engine runs faster. The air flow and fuel passing the actuator serves to cool the magnetic circuit and magnetizing coils, thereby improving the duty cycle capability of the actuator and allowing it to operate at higher frequency rates. This is accomplished by orienting the support vanes to jointly serve as cooling fins and by locating the fuel inlet passages in an optimum position relative to the actuator. The duct may be supplied with both gaseous and liquid fuel, allowing starting with one and running with the other, or using either or both according to power requirements. The improved fuel mixing and volumetric efficiency provides improvements in emissions. As the liquid fuel may be injected or ported to enter high in the duct spraying onto the actuator and support vane surfaces, latent heat of vaporization of the fuel is used to provide the above mentioned cooling effects and further allow size reduction of the actuator.

A further object of the invention is directed to the inwardly facing actuator support vanes which are oriented to impart spin to the intake gas. This spin creates a mixed swirling flow as the gas approaches and enters the combustion chamber, thereby controlling the direction of flow into the chamber and improving the combustion process.

A final object of the invention consists of the ability of the invention to be used for intake valves and also for exhaust valves with equal ease. The same principle applies to both applications, except no fuel distribution ports are required for the exhaust. The invention also provides for cooling the actuator with engine coolant or lubricating oil, which is routed through suitable passages in the vanes to cool the actuator directly when used with an exhaust valve furthering not only the utility, but prolonging the life of the actuator by reducing the working temperature.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
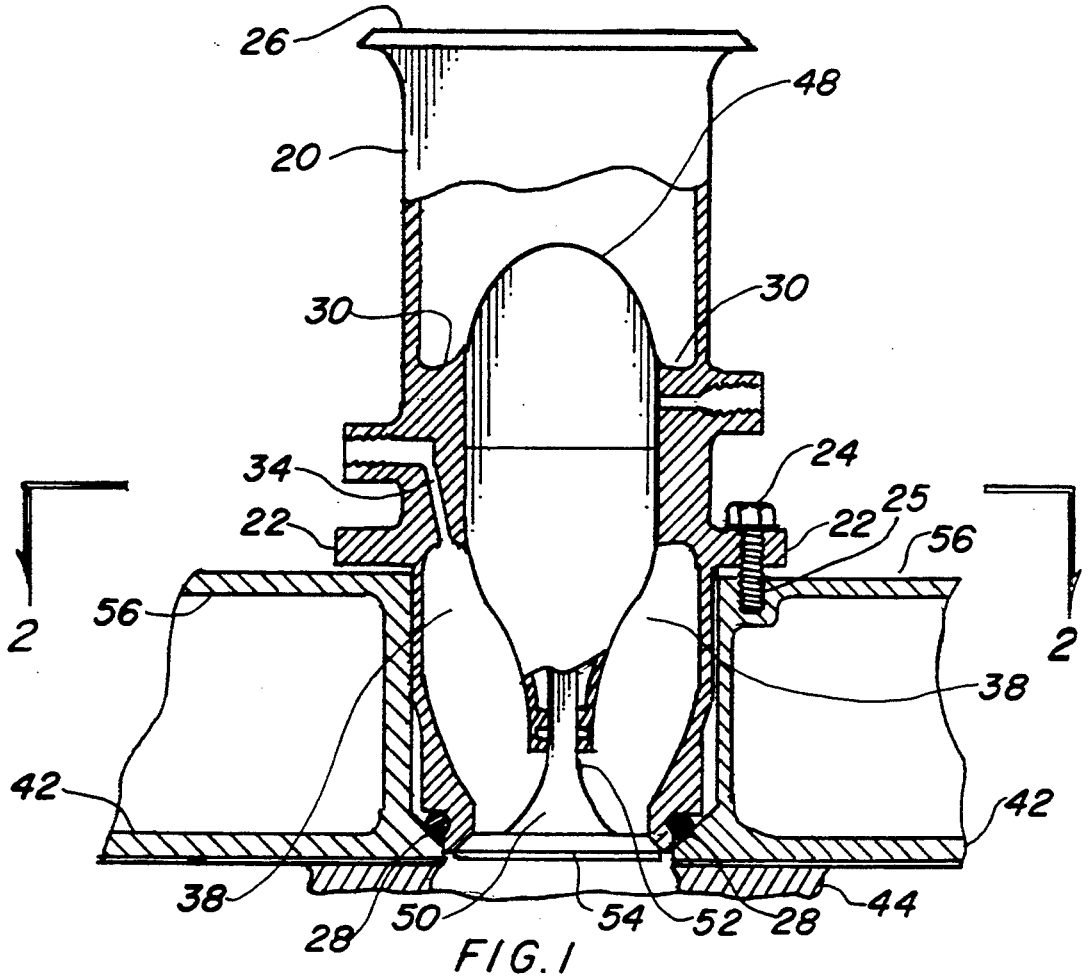
FIG. 1 is a partial cross-sectional view of the preferred embodiment including a fragmentary section of the engine block.
Figure 2:
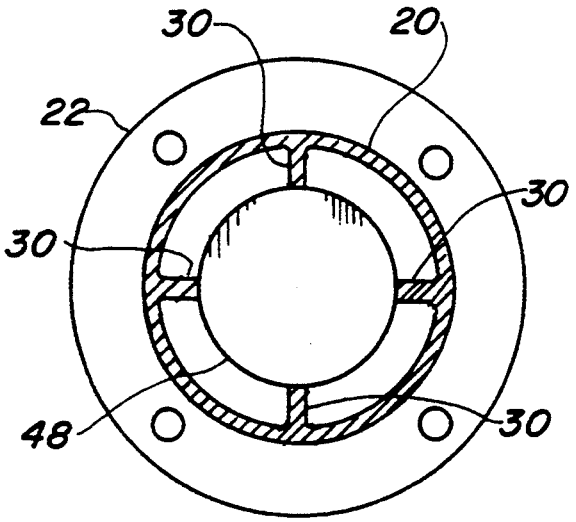
FIG. 2 is a cross-sectional view taken along lines 2—2 of FIG. 1.
Figure 3:
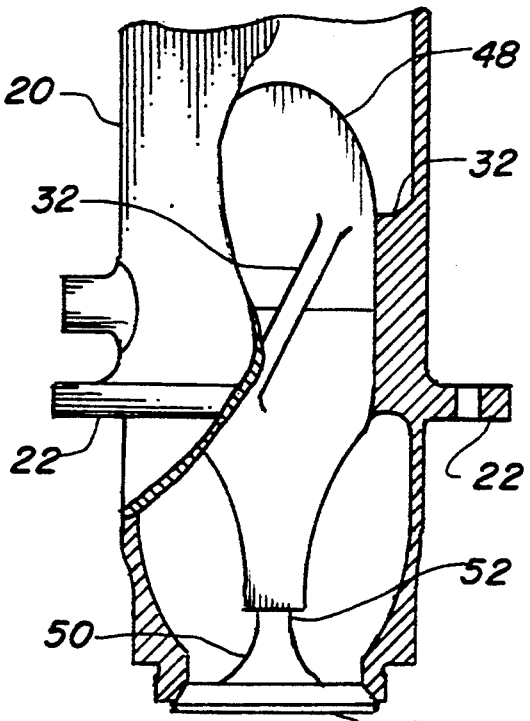
FIG. 3 is a partial cross-sectional view of the preferred embodiment illustrating the spiral angle of the inwardly facing vanes.

The best mode for carrying out the invention is presented in terms of a preferred embodiment, with some variations in individual details, as well as a separate exhaust valve embodiment. The preferred embodiment, as shown in FIGS. 1 through 8, is comprised of co-axial venturi duct 20. This duct 20 is hollow and cylindrical in shape and contains attaching means in the form of an outwardly extending flange 22 with holes to receive threaded fasteners, specifically capscrews 24, that attach to mating threaded holes 25 in the engine. This method of attachment permits the individual valve actuating device to be separately removed and replaced from the engine 42 without the necessity of disassembling other engine components. The duct 20 interfaces with the engine 42 in a contiguous manner employing seal means in the form of an o-ring 28 of suitable resilient material creating a removable leak tight joint. The duct 20 may be constructed of any type of material, preferably of a metallic nature, such as steel or aluminum.

The duct 20 contains a bell mouth 26 on the end opposite the duct interface with the engine 42 which radially increases the diameter of the hollow co-axial area within the duct inlet to preclude kinetic and thermal energy losses from turbulent flow entering the device. This bell mouth is illustrated in FIGS. 1, and 4 through 7, and is radiused on the upstream or open end where it may be attached to an intake manifold or directly to an air cleaner in some simple engine applications.

Figure 8:
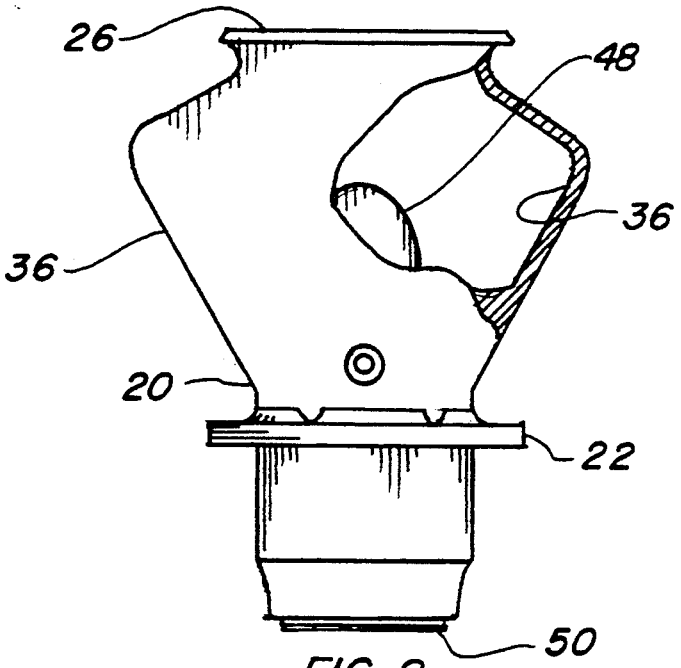
FIG. 8 is a view of the preferred embodiment illustrating the reflective baffle in combination with the bell mouth inlet embodiment.

Another variation of the venturi duct 20 is illustrated in FIG. 8 wherein the bell mouth 26 is combined with a reflective baffle 36. This baffle 36 is formed directly below, or specifically on the downstream side of the bell mouth 26, and because it increases in overall diameter, or radius of the hollow co-axial area of the duct 20, kinetic and thermal energy losses are further decreased. The baffle 36 also becomes a reflector to acoustically discriminate the incoming combustion air into the device furthering the optimum operation of the duct 20.

Inside the hollow co-axial portion of the duct 20 are a number of inwardly facing vanes 30 creating a mounting surface in the center with sufficient area in between for a fluid, such as air or exhaust to pass with minor obstruction. The vanes 30 are either straight, parallel with the flowpath, or they may be spirally angled 32 relative to the hollow duct 20 creating a rotational spin for mixing and optionally controlling the flow of fluid therethrough. The vanes 30 are illustrated straight in FIGS. 1 and 2 and are spirally angled 32 in FIG. 3.

In the intake valve embodiment, illustrated in FIGS. 1 through 8, the vanes 30 include fuel injection means which provide an efficient and convenient system of fuel introduction into the engine cylinders 44. While an infinite variation of approaches may be utilized, three distinct methods are apparent. FIG. 1 illustrates the first variation in which the vanes 30 contain a number of passages 34 for combustible liquid fuel. The liquid is forced under pressure through the passages 34 terminating in orifices at the leaving edge of the vanes 30 where it sprays into the venturi throat of the duct 20. The result is that the fuel in the liquid state is atomized into fine droplets that change state to a vapor when mixing with inlet air from the open end of the duct 20. The fuel and air mixture then is ingested into the engine cylinder 44 for combustion at the proper timing.

Figure 4:
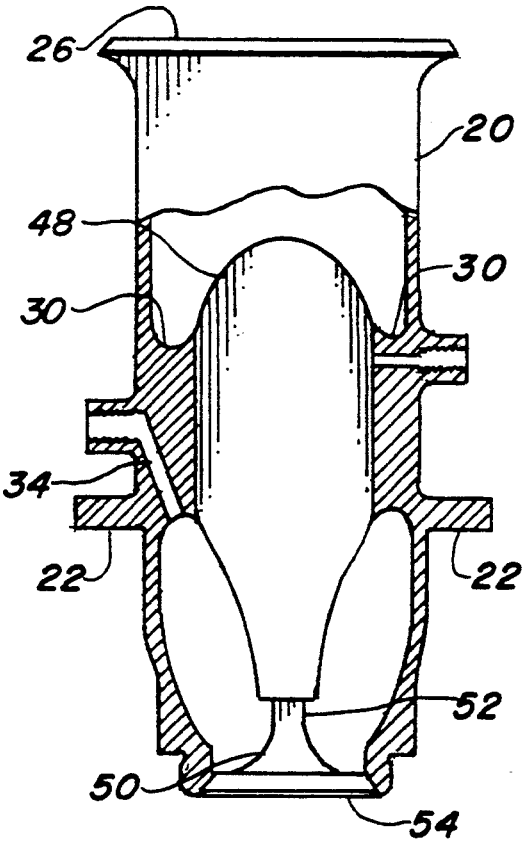
FIG. 4 is a partial cross-sectional view of the preferred embodiment illustrating the vapor fuel injection passageway embodiment.

The second embodiment of the fuel injection means is shown in FIG. 4 and is similar to the above system, except the passages 34 are larger, permitting combustible gaseous fuel to be drawn into the duct interior using the depressed pressure created by the venturi throat 38 configuration of the duct 20 itself. Since the velocity increases around the vanes 30 and then opens to a lower velocity on the leaving side, the resultant negative pressure draw the gaseous mixture into the duct 20, much like a naturally aspirated automotive carburetor.

In each of the above embodiments the fuel injection means operates as a carburetor and the valve opening time may be controlled by an engine computer and serve as a throttling function. If the valve is opened a short time, throttling occurs and the engine runs slowly. If the valve is opened longer, the engine runs faster.

Figure 5:
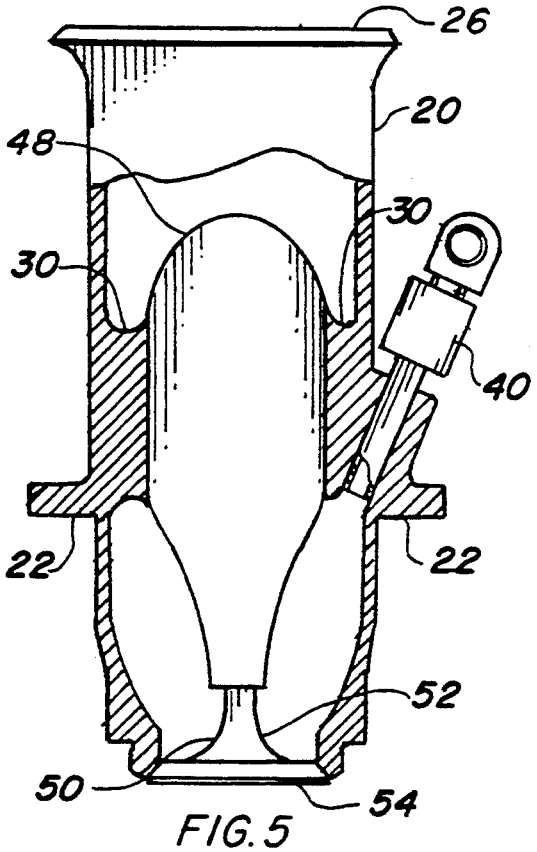
FIG. 5 is a partial cross-sectional view of the preferred embodiment illustrating the fuel injection nozzle embodiment.

The third configuration is depicted in FIG. 5 and utilizes a high pressure fuel injection nozzle 40 disposed within one or more of the vanes 30. This type of nozzle 40 is used in both gasoline and gaseous fueled engines and is well known in the art, needing no explanation for its functional operation.

While all of the above embodiments of the fuel injection means are described and shown located within the vanes 30 the invention is not limited to that orientation only, as the injector means may be positioned above the vanes with equal ease and dispatch, dispersing the fuel into the duct 20 and mixing with the induction air. The latest heat of vaporization of the fuel has a secondary effect enhancing cooling of the actuator 46 positioned below in the airstream.

Figure 6:
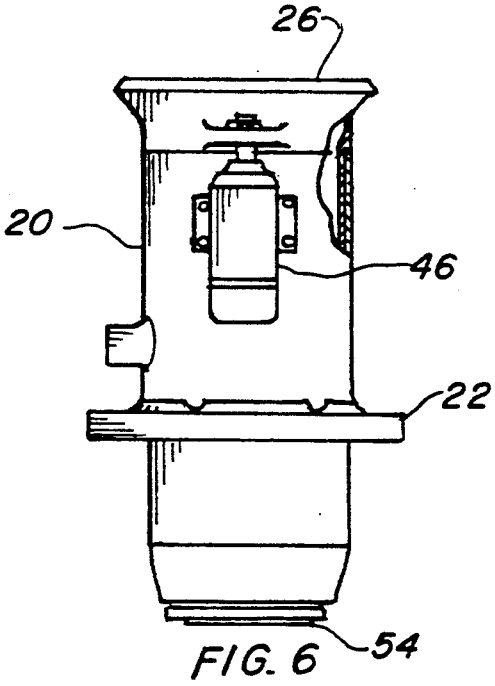
FIG. 6 is an elevational view of the preferred embodiment including the adjustable length means in the minimum length.
Figure 7:
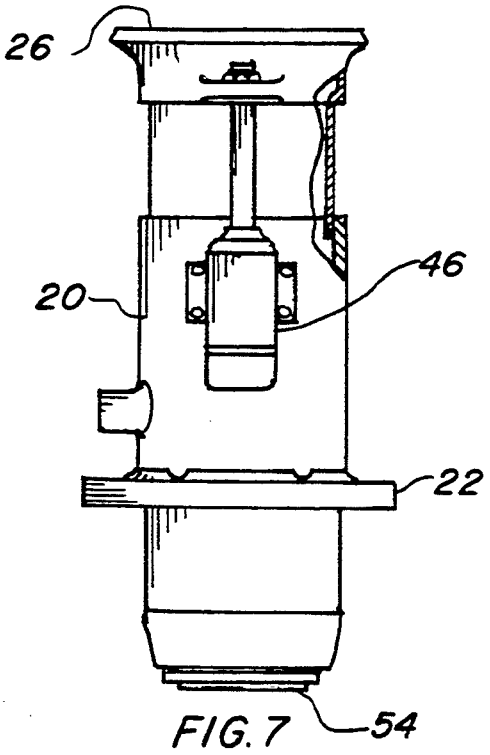
FIG. 7 is an elevational view of the preferred embodiment including the adjustable length means in the maximum length.

Another alternative embodiment of the device includes the addition of adjustable length means within the duct 20 itself. FIGS. 6 and 7 depict this feature in its most basic form. The length of the duct 20 is sensitive to the pulsation frequency of the engine. If the duct length corresponds acoustically to the frequency of the engine, a harmonic is created that improves the overall volumetric efficiency, therefore the duct 20 is made in two pieces that slip together such that the length may be varied to achieve this ability. A linear actuator 46 is attached to one or more sides of the duct 20 and by sensing the frequency of the engine, the device may be tuned to achieve the desired length by expanding or contrasting the actuator. Sensing devices and linear actuators 46 are well known in the art and, therefore, require no further explanation. It will be noted, however, that the invention is not limited to the linear actuating device, illustrated as electric, hydraulic, pneumatic type may be utilized all with equal ease and dispatch.

The basic operating element of the invention is the electromechanical valve actuator 48 that is positioned in the center of the duct 20 and held securely in this position by the vanes 30. The location of the actuator directly in the center between the vanes 30 parallel with the inside of the duct 20 permits a flow of gas in the form of combustion air or exhaust to pass in a straight line maintaining inertia and minimizing static and dynamic pressure loss.

The electromechanical valve actuator presently best suited for the application is taught in U.S. Pat. No. 5,222,714, and is available from AURA SYSTEMS, INC. in El Segundo, Calif. This actuator is electromagnetic in operation containing an upper and lower electromagnetic element with an annular horizontal core in between. A spring is positioned on each side of the core and as current is applied, the appropriate element creates a magnetic field drawing the core into its presence, thus, alternatively reciprocating a valve 50 that is partially positioned within. The valve 50 is illustrated in FIGS. 1 and 3 through 5 inserted into the actuator with the stem 52 and head or poppet 54 extending downwardly away from the actuator. It will be noted that the configuration of the actuator 50 is cylindrical with an elliptical head on the leading end and the trailing end is tapered inwardly, almost to the same diameter as the stem 52, creating a streamlined shape that directs the airstream around the leading end and promotes the negative pressure in the venturi shape for the above mentioned fuel injection function. It may also be noted that while the valve head 54 is illustrated moving inward toward the engine 42 combustion chamber, the opposite or outward movement may be utilized with equal ease.

Further, the alignment parallel with the duct 20 allows the primary object of the invention to be realized, permitting gas flow parallel to the valve stem which forms free and uniform flow around the full periphery of the valve head.

In operation, the actuator 48 receives electrical signals in the form of frequency modulation which is originated by a microprocessor, or the like, again well known in the art, and lifts the valve at the appropriate timing to coincide with the timing of the balance of the internal combustion engine particularly the spark ignition system. The fuel injection may also be timed in the same manner controlling precise engine speed and performance.

Figure 9:
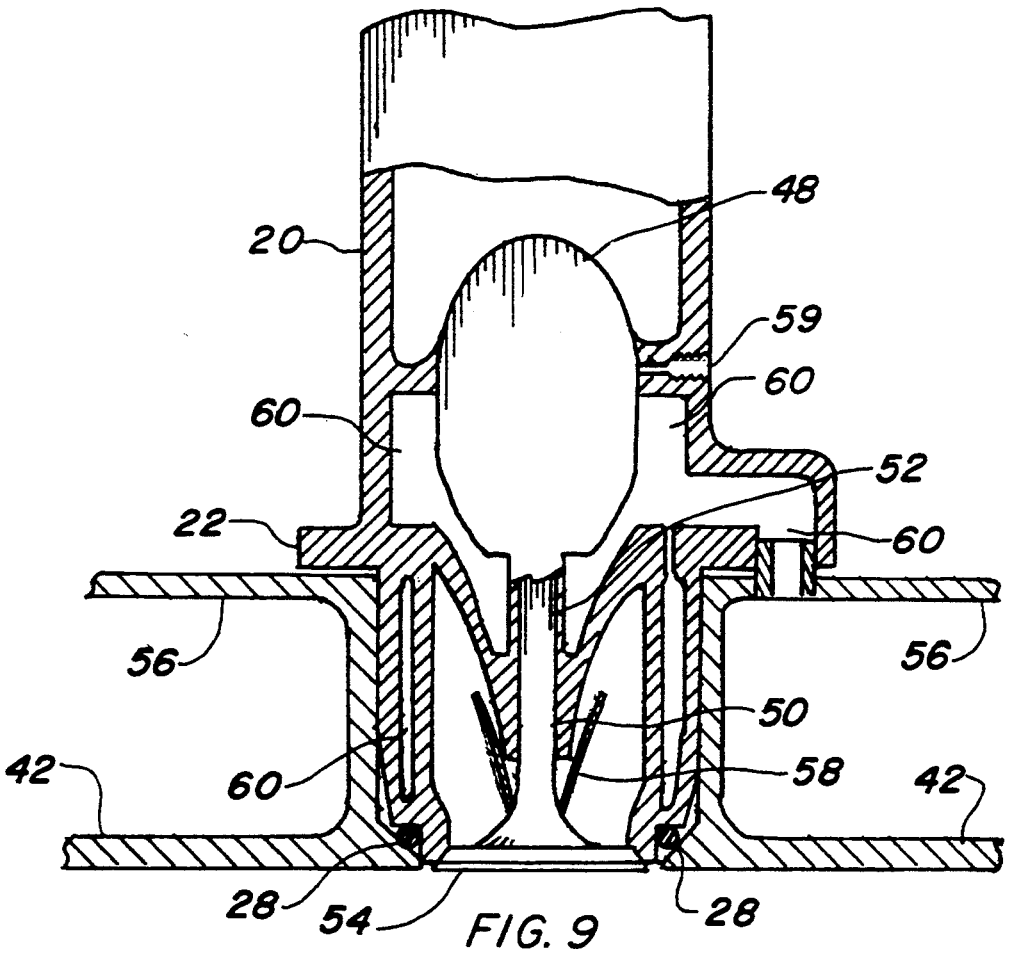
FIG. 9 is a partial cross-sectional view of the exhaust valve embodiment cut-away to illustrate the cooling means in the fins.

A separate exhaust valve embodiment is depicted in FIG. 9 and utilizes most of the same elements as described above, less the fuel injection means. The flow of the exhaust cycle is obviously reverse of the intake, however, the shape of the actuator 48 and position of the vanes 30 is conducive to minimal pressure loss and the fact that the gas flow does not require an abrupt angular turn substantially improves the efficiency of the engine in which the invention is applied.

The exhaust embodiment permits attachment directly to the engine block 56 above each cylinder 44. The duct 20 may be configured straight or in a shape to conveniently attach to an exhaust header. The vanes 30 are preferably straight, however, a swirl may be used if beneficial to the exhaust system. Again, the duct 20 may be turned to the engine using the split duct with a linear actuator 46.

A heat shield 58 may be positioned over the valve stem 52 directly above the valve head 54 to divert exhaust gases away from the actuator 48, as shown in cross-section of FIG. 9. This shield 58 may be any material, such as metallic, ceramic, or other heat resistant material formed into a protective shape. Air may be introduced at a port 59 in the duct 20 and exhausted around the valve stem 52. This airflow serves to keep exhaust products from entering and fueling the actuator thereby maintaining the actuator 48 cleaner and cooler.

The vanes 30 of the invention in this embodiment may further contain cooling means in the form of interconnecting cavities 60 in which an engine coolant may be circulated. The coolant not only includes the conventional aqueous solution of inhibited ethylene glycol and water, but crankcase oil may be used, or even a separate heat transfer fluid with its own circulation system and air to liquid heat exchanger.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A reciprocating internal combustion engine valve actuating device disposed above each cylinder in an engine, the device comprising;

a cylindrical venturi duct having attaching means for securement to the engine, the duct is coaxial with a poppet valve;

a plurality of inwardly facing vanes within the venturi duct having fuel injection means therein, and an electromechanical valve actuator centrally disposed within the duct supported by the vanes, said actuator having the poppet valve with a stem disposed within the valve actuator substantially parallel with the duct, the valve being reciprocated by electrical impulses creating an entrance from the duct to the engine cylinder for controlled induction.

2. The valve actuating device in claim 1 wherein said venturi duct further comprises a radially decreasing bell mouth which precludes kinetic and thermal energy losses.

3. The valve actuating device as recited in claim 1 wherein said venturi duct further comprises a combined bell mouth and reflective baffle, the bell mouth precludes kinetic and thermal energy losses, and the reflective baffle enhances acoustic properties.

4. The valve actuating device as recited in claim 1 further comprising said co-axial venturi duct having adjustable length means such that duct pulsations are tuned to a harmonic frequency resonating to coincide with the engine rotational speed thus increasing volumetric efficiency therewith.

5. The valve actuating device as recited in claim 1 wherein said duct attaching means further comprise a plurality of threaded fasteners and seal means permitting the device to be removed from the engine and replaced as necessary for repair of the engine.

6. The valve actuating device as recited in claim 5 wherein said seal means further comprise a resilient o-ring compressed by said fasteners between the duct and the engine.

7. The valve actuating device as recited in claim 1 wherein said vanes are spirally angled relative to the venturi duct creating a rotational spin flowpath within the duct for mixing and controlling fluid flow therethrough.

8. The valve actuating device as recited in claim 1 wherein said fuel injection means further comprise said inwardly facing vanes contain a plurality of passages terminating at outlet ports directed into the duct interior for introducing combustible liquid fuel into a cylinder of the engine upon valve reciprocation opening a passageway from the duct to the engine.

9. The valve actuating device as recited in claim 1 wherein said fuel injection means further comprise said inwardly facing vanes contain a plurality of passages that terminate at outlet ports above the valve and below the actuator within the duct interior for drawing combustible gaseous fuel into the duct interior by reduced pressure created by a venturi within the duct directly beneath the outlet ports.

10. The valve actuating device as recited in claim 1 wherein said fuel injection means further comprise a high pressure fuel injection nozzle disposed within the vanes for injecting atomized fuel into the duct interior and subsequent induction into the engine.

11. A reciprocating internal combustion engine valve actuating device disposed above each cylinder in an engine, the device comprising;

a cylindrical hollow duct having attaching means for securement to the engine, the duct is coaxial with a poppet valve, a plurality of inwardly facing vanes within the hollow duct, and an electromechanical valve actuator centrally disposed within the duct supported by the vanes, said actuator having the poppet valve with a stem disposed within the actuator substantially parallel with the duct, the valve being reciprocated by electrical impulses creating an entrance from an engine cylinder to the duct for timed exhaust.

12. The valve actuating device as recited in claim 11 wherein said hollow duct has adjustable length means such that the pulsation of the engine creates a harmonic frequency resonating to coincide with the engine rotational speed to increase volumetric efficiency.

13. The valve actuating device as recited in claim 11 wherein said duct attaching means further comprise a plurality of threaded fasteners and seal means permitting the device to be removed from the engine and replaced as necessary for repair of the engine.

14. The valve actuating device as recited in claim 11 further comprising a heat shield disposed upon the stem of the valve for diverting exhaust products away from the actuator.

15. The valve actuating device as recited in claim 11 further comprising cooling means within the vanes to transfer heat away from the electromechanical valve actuator.

16. The valve actuating device as recited in claim 15 wherein said cooling means further comprise an aqueous solution of water and inhibited ethylene glycol circulated within the vanes.

17. The valve actuating device as recited in claim 15 wherein said cooling means further comprise oil circulated within the vanes.

18. The valve actuating device as recited in claim 11 wherein said venturi duct further includes a port through said vanes, in communication with said valve actuator, permitting air to be introduced into the actuator to exclude exhaust products from entering therein.

* * * * *